US005653470A

United States Patent [19]

Bennett

[11] Patent Number: 5,653,470

[45] Date of Patent: Aug. 5, 1997

[54] METAMORPHIC BOOK

[76] Inventor: David Stephen Bennett, 64 Beaumont Avenue, St Albans, Hertfordshire AL1 4TN, Great Britain

[21] Appl. No.: 249,281

[22] Filed: May 26, 1994

[30] Foreign Application Priority Data

Jul. 24, 1993 [GB] United Kingdom ..... 9315375

[51] Int. Cl.[6] ..... B42D 15/00

[52] U.S. Cl. ..... 281/15.1; 281/38; 281/51; 283/63.1; 283/117

[58] Field of Search ..... 281/5, 15.1, 21.1, 281/22, 28, 29, 38, 51; 283/63.1, 117; 446/147, 148

[56] References Cited

U.S. PATENT DOCUMENTS

| | | | |
|---|---|---|---|
| 2,546,878 | 3/1951 | Townley | 446/148 |
| 4,120,100 | 10/1978 | Dugan | 446/147 X |
| 4,627,640 | 12/1986 | Markovics | 281/51 X |
| 4,819,963 | 4/1989 | Wolski | 281/15.1 |
| 5,014,455 | 5/1991 | Desaderata | 446/147 X |
| 5,232,371 | 8/1993 | Day-Cain | 281/15.1 X |

*Primary Examiner*—Willmon Fridie, Jr.
*Attorney, Agent, or Firm*—Iandiorio & Teska

[57] ABSTRACT

The present invention relates to an object that, in its closed configuration, rather than resembling a sculpture preferably has an essentially book-like form. In most instances the pages may be shaped but the covers of the book are flat and play an integral part in the stability of the alternative configuration adopted by the book in the open configuration. Each of the pages is also self-supporting on the binding in the open configuration, preferably also having sufficient rigidity to bear on its edge all or a substantial part of the weight of the rest of the book.

16 Claims, 1 Drawing Sheet

METAMORPHIC BOOK

BACKGROUND

This invention relates to books that can be transformed to or presented as other articles such as playthings or ornaments.

In recent years there have been various developments with books for young children rendering them more versatile as playthings as well as books. For example books have been made with structures to facilitate finger puppetry, and collections of books have been provided with rocking or other novel containers.

The present invention is directed towards providing a book that may also be a plaything or an object other than a simple book. An advantage in such an arrangement is that it may provide versatility not only in the uses and interest of the book, but also in enabling alternative methods of display and storage for books other than the conventional bookcase.

DESCRIPTION OF PRIOR ART

U.S. Pat. No. 4,819,963 discloses a combination book and three dimensional sculpture. The sculpture is provided with a split through the centre so that the two halves can be hingedly interconnected and separated. Within the sculpture are a plurality of pages which are also interconnected at the hinged edge of the sculpture. The pages are cut to a shape in registration with the outline defined by the cut surface of the structure.

In essence, the sculpture maybe regarded as an extension of decorative book covers, in this instance the idea extending such that in its closed configuration the book resembles a sculpture possibly even disguising that the object is a book.

U.S. Pat. No. 4,120,100 illustrates an educational book device with a spiral binding that opens to form a globe or other three dimensional shape. The binding has a hinge midway along its length to enable flaps on individual pages to lie flat or be made to extend from the page by rotating the respective halves of the spine towards one another. When the flaps are extended and the pages fanned apart the flaps act as spacers to hold the pages apart in an open configuration. Pockets for interconnection with the flaps are also provided.

SUMMARY OF THE INVENTION

The present invention relates to an object that, in its closed configuration, rather than resembling a sculpture preferably has an essentially book-like form. In most instances the pages may be shaped but the covers of the book are flat and play an integral part in the stability of the alternative configuration adopted by the book in the open configuration. Each of the pages is also self-supporting on the binding in the open configuration, preferably also having sufficient rigidity to bear on its edge all or a substantial part of the weight of the rest of the book.

DESCRIPTION OF THE DRAWINGS

The invention is now described by way of example with reference to the accompanying drawings in which.

DETAILED DESCRIPTION OF PREFERRED EMBODIMENTS

Figure 1:
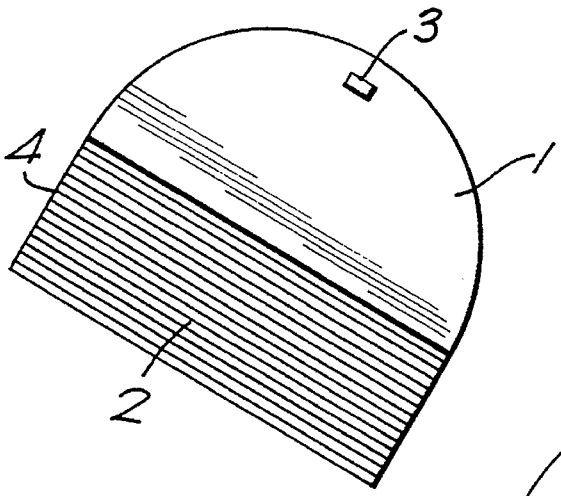
FIG. 1 is a schematic perspective view of a preferred embodiment of the invention in a closed, book configuration.

The basic principle of the invention is the provision of a metamorphic book, by which is meant a book that can be configured to adopt an alternate shape of an object other than a book. In some instances particularly suited to very young children, the book maybe permanently configured in the alternate shape.

Referring to the drawings, the preferred embodiment comprises a board book that can be configured also to form a ball.

The book comprises a pair of outer pages 1 and a plurality of inner pages 2. Each of the pages 1, 2 has the shape of a half circle with the pages joined at a spine 4 along the diameter edge of the half circle.

In the closed configuration as shown in FIG. 1 the book has a half-disc shape but apart from that can be opened as a traditional book. To reach the alternative configuration the pages are fanned out and the spine bent back on itself until the outer pages 1 meet with their outer surfaces abutting. This configuration is shown in FIGS. 2 and 3.

Figure 2:
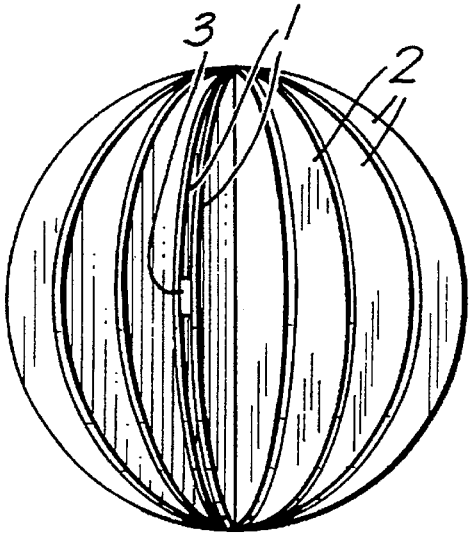
FIG. 2 is a schematic side view of the embodiment of FIG. 1 in an open transformed configuration.
Figure 3:
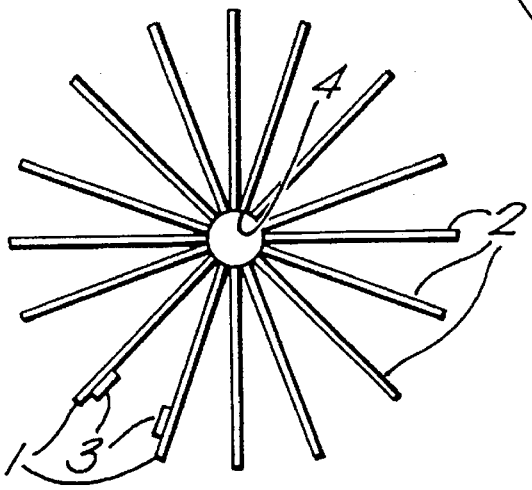
FIG. 3 is a schematic plan view of the embodiment of FIG. 1 in the open configuration.
Figure 4:
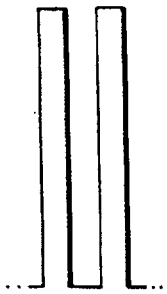
FIG. 4 is a schematic cross-section through a page of the embodiment of FIG. 1.

In the fanned configuration, as can be seen from FIGS. 2 and 3, the outer pages 1 are held together by a catch 3 and the inner pages 2 are substantially uniformly fanned out to make a ball. The radius and number of the pages determines the ease with which the ball will roll. It is preferred to have a minimum of ten pages, more preferably at least fourteen for a ball book with a page radius of 5 cm. For larger ball books the number of pages should preferably increase roughly proportionately to the radius to prevent the ball from becoming too static. To provide sufficient rigidity to the structure in the open configuration the pages are typically made from double thickness of 350 to 500 gsm paper. In the fanned apart configuration the pages are self supporting on the spine, that is they will maintain a generally uniform and stable angular separation rather than being loosely rotatable.

Any suitable form of catch 3 maybe used, although it will be appreciated that suitability for the age of the user needs to be taken into account. For younger children a hook or fastening of the type sold under the Trade Mark 'Velcro' is preferred. In some embodiments the covers may be permanently joined so that the book is always in the fanned apart open configuration.

Manufacture of the metamorphic book made from board may be by any normal board book printing and binding procedure. For example, in one procedure an elongate board that is printed on one side is folded in a concertina manner with alternate folds (i.e. the folds that open on the unprinted side) being stuck together to form a page. An alternative process is to print pairs of confronting pages which are then stuck back to back with adjacent pairs of pages. After the pages have been assembled, the spine edges of the pages are glued and the shape of the pages is die cut. The spine does not require the usual covering, or if one is provided it needs to be flexible. It will be appreciated that the spine must be of a construction to give angular support to the pages, a loose or ring binding would enable the pages to rotate too freely and the open configuration to collapse. In alternative embodiments the pages may not all have the same shape as one another and may need to be pre-cut to shape. If pages are die cut this will be done before gluing or pages will be punch cut after gluing, depending on the shape required.

Figure 5:
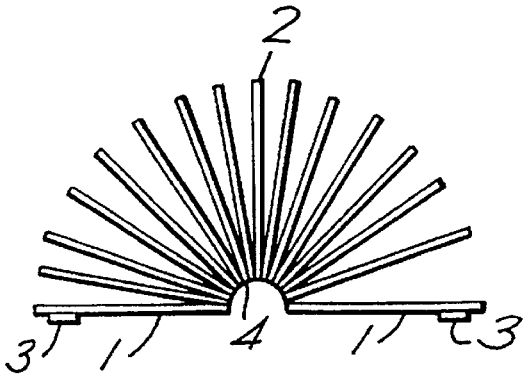
FIG. 5 is a schematic side view of an alternative embodiment.

It will be appreciated that shapes other than semi-circular may be cut, for example to provide cylindrical, ellipsoidal or turned shapes that will roll, or to define an ornamental or animal shape. In some instances, for example animal or vehicle shapes, the book may be adapted to reach its open configuration with the outer pages 1 separated by an angle rather than abutting, for example with a 180° angle as shown in FIG. 5 to form a base. In the embodiment shown in FIG. 5 the pages do not all have the same profile. In other embodiments more than one open configuration may be provided.

For use as a rolling plaything the pages need to be relatively rigid, for example as described with a board book structure. Other materials may also be used, such as wood, sponge, rubber or plastics materials, or composite structures such as stuffed cloth pages or card or sponge between cloth, and dependent upon the nature of the open configuration article may have less rigidity or be resilient. A more general requirement is for the pages to be self-supporting, both as individual pages and for stable angular separation. The nature of the interconnection of the pages at the spine edge is adapted to suit the material of the pages and may include stitching or springs.

It will be further appreciated that the interconnection of the pages at the spine edges also contributes to the self supporting nature of the book in the open configuration, providing resistance to the pages falling against one another.

In further embodiments composite construction may be used, such as trimmings on the pages to give resilient, soft or furry external edges. Some trimmings maybe incorporated in a sandwich structure with the pages. Stiffeners such as card or ribs may be included within pages of less rigid material.

Other structures that may be included within the pages of metamorphic books include holes in various parts of the book through which a finger puppet or length of wool or ribbon, for example, can be inserted. Pages may also have flaps that can be lifted, such flaps either having cuts extending through both sides of the page so that the same flap can be pushed or lifted from both sides of the page, or alternatively a flap maybe provided on just one side of a page. Flaps may be interlinked or extended to create pop-up structures.

An important feature in giving sufficient ruggedness to the structure is the thickness of the pages and the resulting width of the spine of the book. It is preferred to have a minimum spine of the book. It is preferred to have a minimum spine width of 0.5 cm. Thus in a 360° open structure the spine defines a cylindrical through channel 5. Structures that are intended to lie with the outer pages 1 as bases, for example as in FIG. 5, may be made with a looser spine to aid retention in the open position in absence of a catch, or a catch such as a swivelling strut of the spine may be used to hold the structure open.

Various accessories may be provided to increase the versatility of the book as a plaything. For example several books of the type having a 360° open configuration may be mounted on a rod or string passing through the spinal channel. Other possibilities may enable a game to be played.

The books described are not limited to use by children. Instead of conversion to playthings the books may convert to objects or ornaments to enable display and/or storage other than in a bookcase, the shape adopted being relevant for example to the subject of the book. Accessories for use with alternative open configuration may also be used.

What I claim is:

1. A metamorphic book comprising:

a pair of substantially flat, rigid book covers;

a plurality of flat, rigid pages, each of the covers and pages having an inward marginal edge; and spine means extending longitudinally in the direction of said marginal edges and having a width interconnecting the inward marginal edges on each of the covers and pages, the spine means being flexible across its width and capable of supporting individual pages radially upright on their marginal edge so that the book can be transformed from a closed, book configuration to at least one open configuration in which the pages adopt a stable fanned out configuration, the individual pages being supported in the fanned configuration by the spine.

2. The metamorphic book of claim 1 in which the pages each comprise board of at least 350 gsm.

3. The metamorphic book of claim 1 in which the pages have a composite structure comprising stiffeners within a material of lesser rigidity.

4. The metamorphic book of claim 1 in which the spine includes a resilient bias.

5. The metamorphic book of claim 1 in which the covers include a fastening device for holding the book in the second configuration.

6. The metamorphic book of claim 1 in which the pages have varying shapes.

7. The metamorphic book of claim 1 in which the spine has a thickness of at least 5 mm.

8. A metamorphic book comprising:

a pair of substantially flat book covers with respective outer surfaces;

a plurality of flat, rigid pages each of the covers and pages having an inward marginal edge; and a spine extending longitudinally in the direction of said marginal edges and having a width interconnecting the marginal edges of each of the book covers and pages; and in which the covers and pages are peripherally shaped and fan apart through over 180° to a stable configuration with the outer surfaces of the book covers confronting one another and the pages individually remaining flat and radially supported solely by the spine.

9. The metamorphic book of claim 8 in which the covers and pages fan apart through substantially 360°.

10. The metamorphic book of claim 9 in which the covers and pages are semicircular and the stable configuration defines a ball.

11. The metamorphic book of claim 9 in which the pages each comprise board of at least 350 gsm.

12. The metamorphic book of claim 9 in which the pages have a composite structure comprising stiffeners within a material of lesser rigidity.

13. The metamorphic book of claim 9 in which the spine includes a resilient bias.

14. The metamorphic book of claim 9 in which the covers include a fastening device for holding the book in the second configuration.

15. The metamorphic book of claim 9 in which the pages have varying shapes.

16. The metamorphic book of claim 9 in which the spine has a thickness of at least 5 mm.

* * * * *